US005083521A

United States Patent [19]

Widing

[11] Patent Number: 5,083,521

[45] Date of Patent: Jan. 28, 1992

[54] EASY OPEN BAILER ATTACHMENT

[76] Inventor: Albert C. Widing, 2683 East Dr., Mio, Mich. 48647

[21] Appl. No.: 632,191

[22] Filed: Dec. 21, 1990

[51] Int. Cl.[5] ..... B63B 13/00

[52] U.S. Cl. ..... 114/183 R

[58] Field of Search ..... 114/183 R, 197, 198

[56] References Cited

FOREIGN PATENT DOCUMENTS 1522635 8/1978 United Kingdom ..... 114/183 R

*Primary Examiner*—Sherman Basinger

*Attorney, Agent, or Firm*—Donald C. Bolger

[57] ABSTRACT

A easy open bailer attachment which provides a way of opening a bailer in one lift of the bailer lever. When lifting the lever it presses against a crossbar attachment and opens the bailer. The crossbar attachment gives the bailer lever an open and closed position feel. The crossbar attachment also give the bailer lever a specific position which verifies that the bailer opened correctly.

1 Claim, 3 Drawing Sheets

EASY OPEN BAILER ATTACHMENT

CROSS-REFERENCES TO RELATED APPLICATIONS: NONE

Statement as to right to inventions made under Federally sponsored research and development: Not Applicable.

BACKGROUND OF THE INVENTION

The field of the invention is generally that of mechanical bailers that remove water from the bottom of water traveling vessels, and more specifically, to an improved easy open bailer attachment for self-bailers that operate on the suction principle.

Automatic bailers or self-bailers are used to remove water from the bottom of boats and have been used for many years. The bailer typically has an exhaust aperture which is directed towards the rear or stern of the boat. Water collecting in the boat is discharged through the exhaust aperture by means of suction created by movement of the boat through the water. These bailers only operate as long as the static pressure of the collected water acting at the exhaust aperture is less than the negative dynamic pressure created at the same place as a resulted of passage of the boat through the water.

As the boat slows down, a point is reached where the water flows back into the boat because not enough suction is produced. To prevent water from flowing back into the boat, various check vales or floats are used or the bailer is simply mechanically closed. When the bailer is closed, water is prevented from entering the boat by seals or by friction fit parts that close the bailer opening making the closure water tight.

Mechanical bailers have a lever that is offset that not only closes the bailer but also acts to lock the bailer in the closed position so that water will not enter the boat. While these levers work properly when closing the bailer, problems exist when opening the bailers. Because bailer levers are designed to lock the bailer in a closed position, the lever is difficult to use when trying to open the bailer as the lever has no toggle open and closed position feel. Because the lever is offset, it is difficult to tell if the bailer is fully opened when looking at the lever. In sail boats or canoe races, such bailers do not work well because too much time is required to open the bailer and ensure that the lever is in the correct position.

The present invention solves this problem by providing a bailer attachment that opens the bailer quickly, easily and provides a positive physical position that indicates that the bailer is opened properly.

SUMMARY OF THE INVENTION

Generally speaking, the present invention comprises a novel easy open bailer attachment for a mechanical type bailer. An attachment is provided that opens the bailer in one lift of the bailer lever. When lifting the lever, the lever presses against the crossbar attachment and opens the bailer. Push the lever down and the bailer is closed.

It is an object of the present invention to provide an improvement to exiting bailers whereby the bailer may be opened easily and quickly.

It is a further object of the invention to provide a novel crossbar that acts as a pivot for the exiting lever.

It is another object of the invention to provide a novel attachment that provides a positive open position feel.

It is a further object of the invention to provide a novel arrangement to ensure the bailer is in the open position.

It is another object of the invention to provide a low cost attachment that is easy to operate.

Further objects are implicit in the detailed description which follows hereinafter (which is to be considered as exemplary of, but not specifically limiting, the present invention) and said objects will be apparent to persons skilled in the art after a careful study of the detailed description which follows.

For the purpose of clarifying the nature of the present invention, one exemplary embodiment of the invention is illustrated in the hereinbelow-described figures of the accompanying drawings and is described in detail hereinafter. It is to be taken as representative of the multiple embodiments of the invention which lie within the scope of the invention.

DESCRIPTION OF THE PREFERRED EMBODIMENTS

Figure 1:
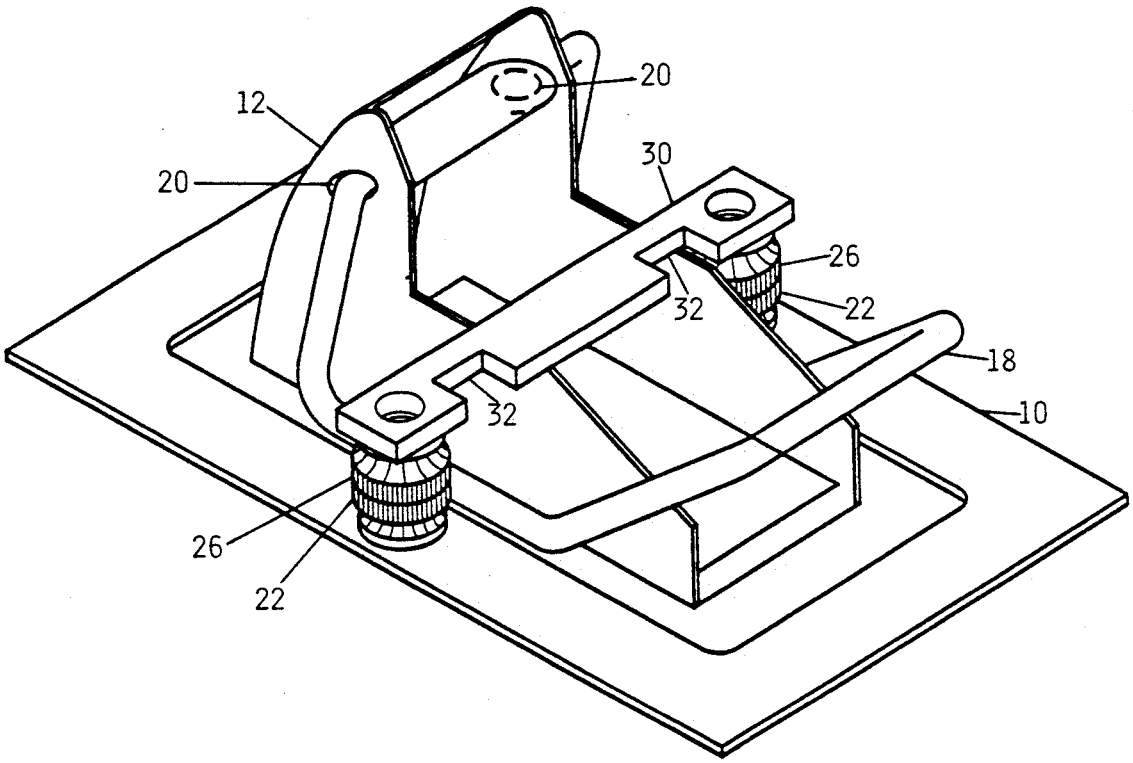
FIG. 1 is a perspective view showing one exemplary embodiment of one representative form of the invention.

Referring to FIG. 1, the bailer assembly has a base 10 which is attached to the bottom of a boat with glue, screws, or other fasteners. Inside of base 10, chute 12 moves up and down by pivoting around chute pivot 14 (FIG. 2).

Figure 2:
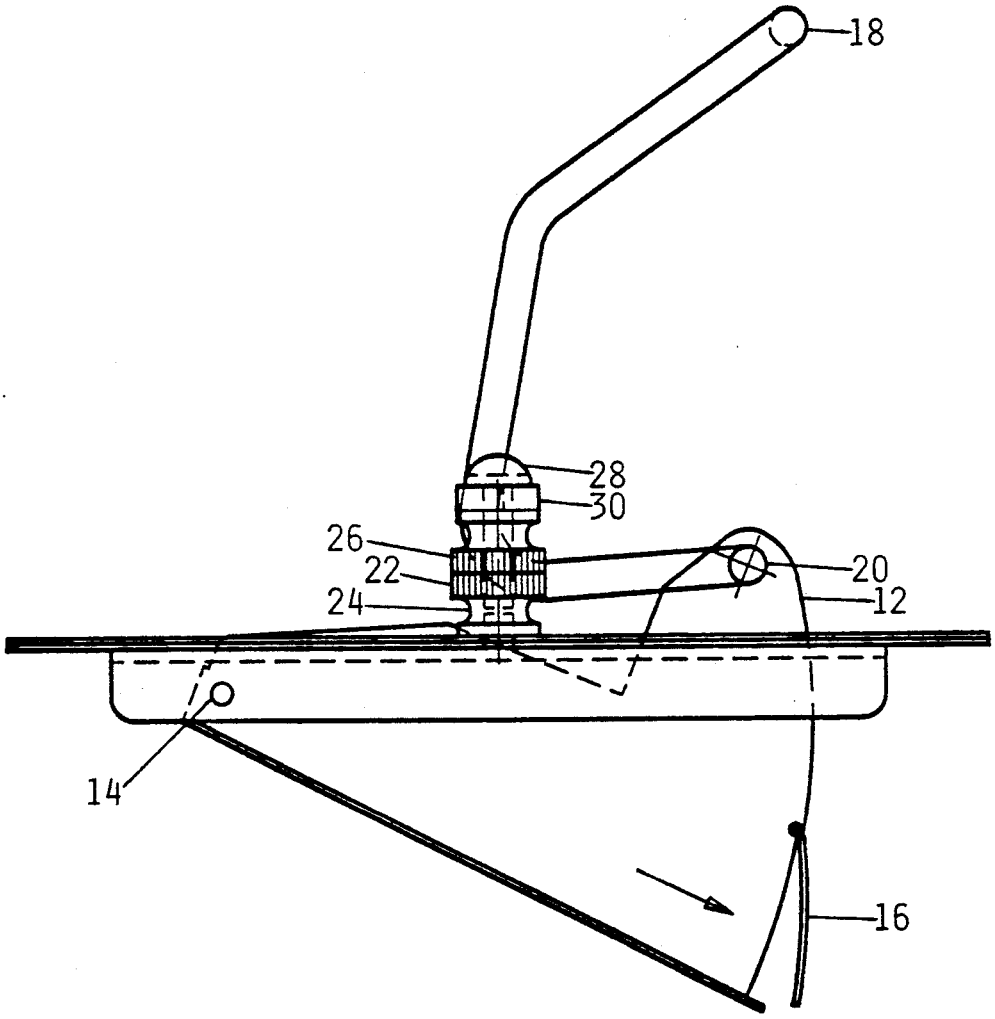
FIG. 2 is a elevation view showing one exemplary embodiment of one representative form of the bailer in the open position.

Referring to FIG. 2, chute 12 is shown in the down position. Door 16 allows water to flow out of the boat and somewhat restricts flow back into the boat.

Figure 3:
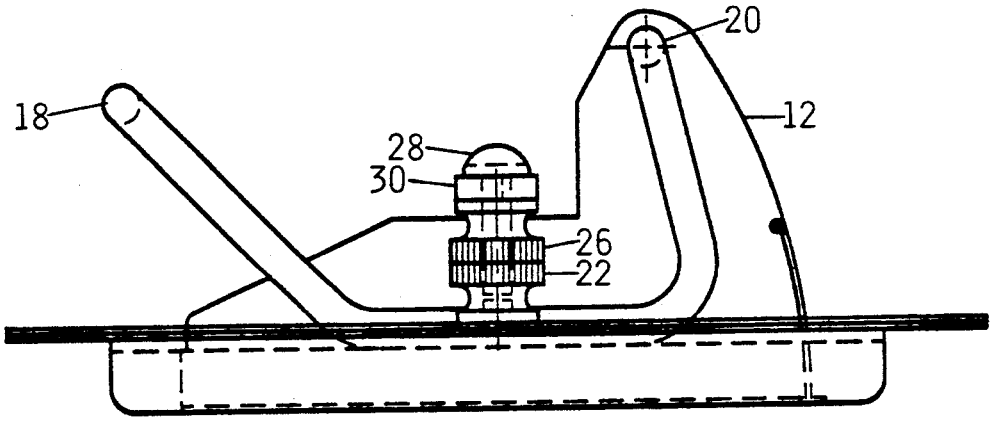
FIG. 3 is a elevation view showing one exemplary embodiment of one representative form of the bailer in the closed position.

Referring to FIG. 3, chute 12 is shown in the up position. Chute 12 seals against base 10 by a friction fit, although gaskets and seals are often used. Lever 18 is attached to chute 12 by chute pivot holes 20. When lever 18 is rocked forward, the chute is forced into a closed position.

Referring to FIG. 3 and FIG. 1, lower spacers 22 have internal threads are secured to anchor screws 24. Upper spacers 26 have internal holes for screws 28. Crossbar 30 has recess portions 32 that act as guides for lever 18.

To install crossbar 30 to an existing bailer assembly, lower spacers 22 are tighten to exiting anchor screws 24. If no screws are present, a hole is drilled through the bailer and then anchor screws 24 are added. Next upper spacers 26 are placed on the top of lower spacers 22 and then crossbar 30 is placed on top of upper spacers 26. Screws 28 are inserted through the crossbar and through the upper spacers 26 and then screws 28 are tightened into lower spacers 22. Crossbar 30 gives an improved pivot point for lever 18 making the opening of chute 12 feel positive in the opened position.

What is claimed is:

1. An improvement in a mechanical bailer, said improvement comprising:

a crossbar;

means for attaching said cross bar to said mechanical bailer; wherein said crossbar has at least one hole near each end that is perpendicular to the longitudinal axis of said crossbar; and wherein said mechanical bailer has a first anchor screw and a second anchor screw, midway along the longitudinal axis of the mechanical bailer; and further including a first spacer having a threaded hole which is securely fastened to said first anchor screw, and a second spacer having a threaded hole which is securely fastened to said second anchor screw; and further including a third spacer having a hole and positioned between said first spacer and the first end of said crossbar and then attached by a first attaching screw; and further including a fourth spacer having a hole and positioned between said second spacer and the second end of said crossbar and then attached by a second attaching screw.

* * * * *